US007971737B2

(12) United States Patent
Newbould et al.

(10) Patent No.: US 7,971,737 B2
(45) Date of Patent: Jul. 5, 2011

(54) ADHESIVELY MOUNTABLE ANGLED WALL SHELF

(75) Inventors: Peter J. Newbould, Milan (IT); Pasquale Cirulli, Milan (IT); Russell G. Pihlstrom, Blaine, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 455 days.

(21) Appl. No.: 11/849,384

(22) Filed: Sep. 4, 2007

(65) Prior Publication Data

US 2008/0053934 A1 Mar. 6, 2008

Related U.S. Application Data

(60) Provisional application No. 60/842,451, filed on Sep. 6, 2006.

(51) Int. Cl.
*A47F 5/08* (2006.01)

(52) U.S. Cl. ..... 211/90.01; 211/85.31; 211/119.009; 248/205.3

(58) Field of Classification Search ..... 211/90.01, 211/90.03, 134, 119.003, 119.009, 119.011, 211/85.31, 87.01, 88.01, 106, 126.9, 126.11, 211/133.6, 181.1, 1, 85.12, 119, 137.5, 133.5; 108/27; 248/205.3

See application file for complete search history.

(56) References Cited

U.S. PATENT DOCUMENTS

| | | | | | |
|---|---|---|---|---|---|
| 626,641 | A | * | 6/1899 | Vaughan | 211/35 |
| 1,325,472 | A | * | 12/1919 | Ide | 211/123 |
| D93,944 | S | * | 11/1934 | Schimmelfeng | D6/566 |
| 2,068,028 | A | * | 1/1937 | Jernson | 211/104 |
| 2,272,524 | A | * | 2/1942 | Johnson | 68/237 |
| 2,287,611 | A | * | 6/1942 | Harbison | 312/313 |
| 3,203,558 | A | * | 8/1965 | Ullman | 211/126.1 |
| 3,595,404 | A | * | 7/1971 | Goldstein et al. | 211/29 |
| 4,024,312 | A | | 5/1977 | Korpman | |
| 4,108,314 | A | | 8/1978 | Racca | |
| 4,248,352 | A | * | 2/1981 | White | 211/88.01 |
| 4,511,047 | A | * | 4/1985 | Elinsky | 211/90.03 |
| 4,969,580 | A | | 11/1990 | Mikhail | |
| 5,255,401 | A | | 10/1993 | Sambrookes et al. | |
| 5,289,927 | A | | 3/1994 | Emery | |
| 5,397,087 | A | * | 3/1995 | Teece | 248/220.42 |
| 5,516,581 | A | | 5/1996 | Kreckel et al. | |
| 6,189,708 | B1 | * | 2/2001 | McNeece | 211/105.1 |
| D442,002 | S | * | 5/2001 | Rodack | D6/566 |

(Continued)

FOREIGN PATENT DOCUMENTS

DE 33 31 016 C2 7/1992

(Continued)

*Primary Examiner* — Darnell M Jayne
*Assistant Examiner* — Stanton L Krycinski
(74) *Attorney, Agent, or Firm* — Kenneth B. Wood

(57) ABSTRACT

A wall mountable shelf for storing items in a shower or bath enclosure includes a frame, a base member connected with the frame, a back plate connected with the frame and arranged to support the frame on the wall, and adhesive arranged between the back plate and the wall for securing the shelf to the wall surface. The frame includes a top rail portion, a front rail portion, and a pair of side rail portions connecting the top rail portion and the front rail portion. Each side rail portion includes a back portion extending downwardly from the top rail portion and a bottom portion extending from the back portion to the front rail portion arranged at an angle of less than 90°.

11 Claims, 1 Drawing Sheet

U.S. PATENT DOCUMENTS

| | | | | |
|---|---|---|---|---|
| 6,231,962 | B1 | 5/2001 | Bries et al. | |
| 6,520,351 | B1 | 2/2003 | Zadro | |
| 6,543,630 | B2 * | 4/2003 | Hope | 211/133.5 |
| 6,569,521 | B1 | 5/2003 | Sheridan et al. | |
| 6,575,315 | B2 * | 6/2003 | Zidek | 211/205 |
| 6,758,355 | B2 * | 7/2004 | Zidek | 211/205 |
| 6,811,126 | B2 * | 11/2004 | Johansson et al. | 248/205.3 |
| 6,883,671 | B2 * | 4/2005 | Rushing | 211/88.01 |
| 6,972,141 | B1 | 12/2005 | Bries et al. | |
| 7,078,093 | B2 | 7/2006 | Sheridan et al. | |
| 7,540,456 | B2 * | 6/2009 | Thompson | 248/205.3 |
| 2001/0020621 | A1 | 9/2001 | Immerman et al. | |
| 2004/0026426 | A1 * | 2/2004 | Rutherford et al. | 220/480 |
| 2005/0189308 | A1 * | 9/2005 | Warner et al. | 211/59.1 |

FOREIGN PATENT DOCUMENTS

| | | |
|---|---|---|
| JP | 2002-482 | 1/2002 |
| KR | 19990038912 | 11/1997 |
| KR | 200243286 Y | 8/2001 |

* cited by examiner

ADHESIVELY MOUNTABLE ANGLED WALL SHELF

CROSS REFERENCE TO RELATED APPLICATION

This application claims the benefit of U.S. Provisional Patent Application No. 60/842,451, filed Sep. 6, 2006, the disclosure of which is incorporated by reference herein in its entirety.

TECHNICAL FIELD

The present invention relates generally to storage articles and, more particularly, to a storage shelf that can be adhesively mounted to the interior surface of a bath or shower enclosure to hold a variety of items commonly used in the bath or shower.

BACKGROUND

Shower and bath storage devices, often referred to as shower or bath caddies, are commonly used to hold and/or store items such as soap, shampoo, and other bath items in shower and bath enclosures. Because of the weight of the stored items and because it is generally not practical to mount such items in shower or bath enclosures using mechanical fasteners, such as nails and screws, such devices are typically hung from the shower nozzle fixture. Such devices are known in the prior art. U.S. Pat. No. 4,969,580 (Mikhail Essatt), U.S. Pat. No. 4,108,314 (Racca), U.S. Pat. No. 5,255,401 (Sambrookes et al.), and U.S. Pat. No. 6,520,351 (Zadro), for example, disclose such devices. It is also known to mount such devices using suction cups as disclosed in, for example, U.S. Pat. No. 5,289,927 (Emery).

Such devices, however, suffer from certain drawbacks and shortcomings. Devices that hang from the shower nozzle fixture, for example, tend to be large and cumbersome and because such devices must hang down from the shower nozzle fixture below the shower head so the items in the caddy can be accessed by a user, they are unstable and tend to swing sideways or slide off of the shower nozzle fixture. In addition, the mounting location is limited by the location of the shower nozzle fixture such that they cannot be moved, and, because they must be mounted immediately below the shower head, they tend to interfere with the use of the shower. Devices mounted with suction cups, on the other hand, have limited holding capacity and tend to lose their holding ability over time. As a result, devices mounted with suction cups frequently fail, thereby causing the device and its contents to fall off the wall.

The need therefore exists for a storage device that can be adhesively mounted to the wall surface of a shower or bath enclosure that is inexpensive, easy to install, and holds strongly enough to support items commonly stored in such devices.

SUMMARY

The invention overcomes the above-identified limitations in the field by providing a storage device that can be adhesively mounted to the wall surface of a shower or bath enclosure that is inexpensive, easy to install, and holds strongly enough to support items commonly stored in such devices.

In one embodiment, the present invention provides a wall mountable shelf for mounting on the wall surface of a shower or bath enclosure including a frame having a top rail portion, a front rail portion, and a pair of side rail portions connecting the top rail portion and the front rail portion. Each side rail portion includes a back portion extending downwardly from the top rail portion, and includes a bottom portion extending from the back portion to the front rail portion. In one aspect of the invention, the side rail back portion and the side rail bottom portion are generally arranged at an angle of no greater than about 90 degrees. The shelf further includes a base removably connected with the frame and extending between at least the side rail bottom portions, at least one back plate connected with the frame and arranged to support the frame on the wall, and at least one stretch removable adhesive strip arranged between the back plate and the wall for securing the shelf to the wall surface.

BRIEF DESCRIPTION OF DRAWINGS

The present invention will be further described with reference to the accompanying drawings, in which.

DETAILED DESCRIPTION

Figure 1:
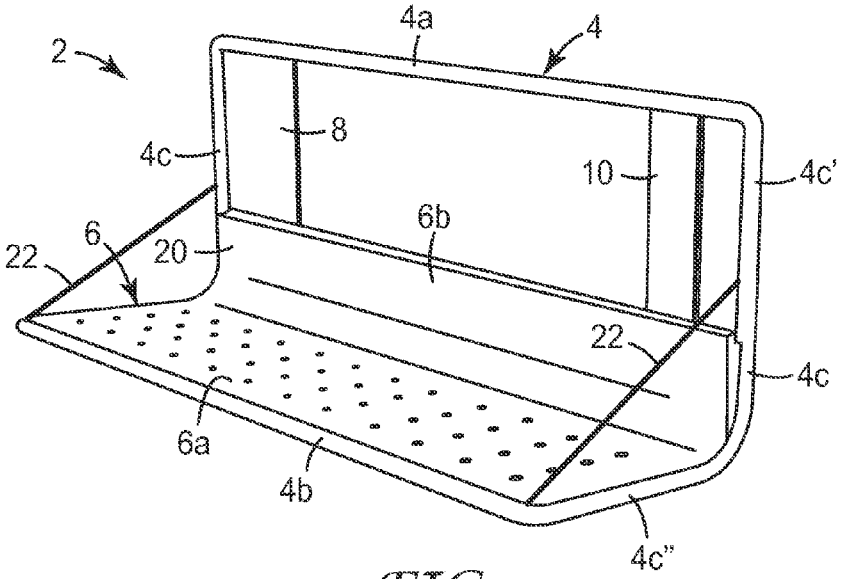
FIG. 1 is a perspective view of an adhesively mountable wall shelf according to the invention.
Figure 2:
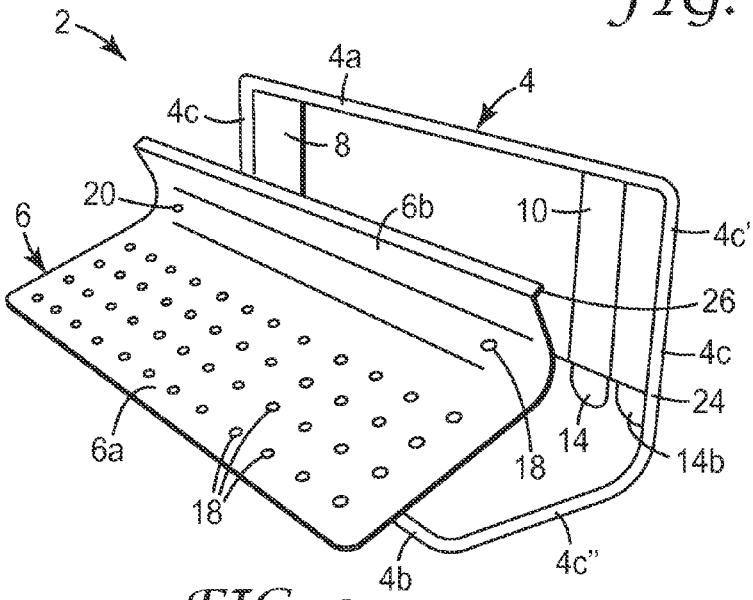
FIG. 2 is a partially exploded view of the shelf of FIG. 1.
Figure 3:
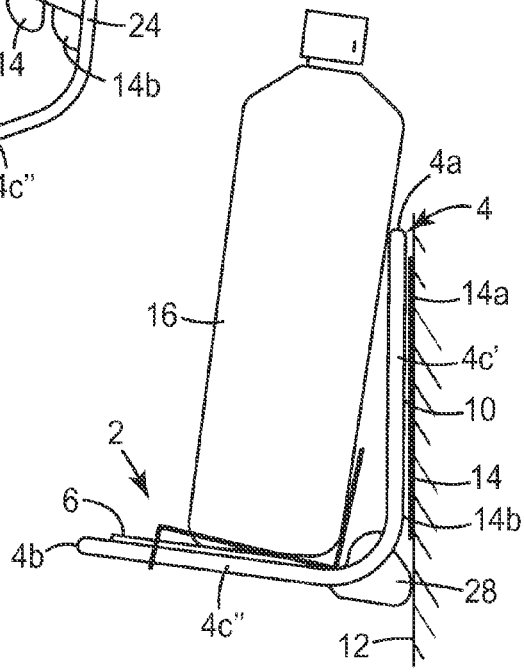
FIG. 3 is a plan side view of the shelf of FIG. 1 mounted to a wall surface with an item placed on the shelf.

Referring now to the drawings, wherein like reference numerals refer to like or corresponding parts throughout the several views, FIGS. 1-3, show a wall mountable shelf 2 for storing items in a shower or bath enclosure. The shelf 2 includes a frame 4, a base member 6 removably connected with the frame 4, a pair of back plates 8,10 removably connected with the frame 4 and arranged to support the frame 4, and adhesive strips 14 arranged between the back plates 8,10 and a wall surface 12 (FIG. 3) for securing the shelf 2 to the wall surface 12. The back plates 8,10 may be removably connected with the frame 4 or the back plates may be affixed relatively permanently to the frame 4, for example, by welding.

Adhesive strips 14 well suited for mounting the back plates 8,10 to the wall surface 12 are the double-sided stretch releasable adhesive strips available from 3M Company, St. Paul, Minn. under the COMMAND trade designation. Commercially available COMMAND adhesive strips are currently manufactured as discrete strips with one end of the strip including a non-adhesive pull tab to facilitate stretching of the strip during removal.

Stretch releasing adhesives are high performance pressure-sensitive adhesives that combine strong holding power with clean removal and no surface damage. The double-sided adhesive strips 14 may be any conventionally known stretch releasing adhesive tape including a stretch releasing adhesive tape with an elastic backing, a stretch releasing adhesive tape with a highly extensible and substantially inelastic backing, or a stretch releasing adhesive tape comprising a solid elastic pressure sensitive adhesive, but are preferably stretch releasable adhesive strips that are moisture resistant (i.e. they maintain their holding power in the presence of water and/or in high humidity environments).

Specific tapes suitable for use in the various embodiments of the present invention include the pressure sensitive adhesive strips with elastic backings described in U.S. Pat. No. 4,024,312 (Korpman), the pressure sensitive adhesive strips with highly extensible and substantially inelastic backings described in U.S. Pat. Nos. 5,516,581 (Kreckel et al.) and 6,231,962 (Bries et al.), 6,569,521 (Sheridan et al.), 7,078,093 (Sheridan et al.), and the solid elastic pressure sensitive adhesive strips described in German Patent No. 33 31 016. Another suitable stretch releasing adhesive construction is the stretch removable adhesive tape laminate including a separable fastener described in U.S. Pat. No. 6,972,141 (Bries et al.).

The shelf frame 4 includes a top rail portion 4*a*, a front rail portion 4*b*, and a pair of side rail portions 4*c* connecting the top rail portion 4*a* and the front rail portion 4*b*. Each side rail portion 4*c* includes a back portion 4*c*' extending downwardly from the top rail portion 4*a* and a bottom portion 4*c*" extending from the back portion 4*c*' to the front rail portion 4*b*. The base member 6 includes a generally flat support surface 6*a* that extends between the side rail bottom portions 4*c*" and includes an inclined back surface 6*b* that extends between a lower portion of the side rail back portions 4*c*'. Because the base member 6 does not extend all the way to the top rail portion 4*a* when the shelf 2 is fully assembled, the back plates 8,10 remain visible through the back of the shelf 2 as shown in FIG. 1.

The side rail back portions 4*c*' and the side rail bottom portion 4*c*" are arranged at an angle of no greater than about 90°. Arranged in this manner, the base member 6 slopes downwardly in the direction toward the wall surface 12 as shown most clearly in FIG. 3, thereby causing items arranged on the support surface 6*a* of the base member 6, such as the container 16 shown in FIG. 3, to tip backward toward the wall surface 12. While not wishing to be limited by theory, it is believed that having items, such as container 16, lean backward toward the top rail portion 4*a* creates a more stable storage device compared to a purely horizontal shelf arrangement because items are captured more securely by the shelf 2. That is, the container 16 is supported along both its bottom surface and along a side surface, whereas a horizontal shelf would support the container only along its bottom surface. In addition, this arrangement is believed to increase the holding capacity of the shelf 2.

An optional abutment member 28 (FIG. 3) may be provided along the bottom of the shelf 2 adjacent the wall surface 12. The abutment 28 is arranged to contact the wall surface 12 as items are placed on the shelf 2. Arranged in this manner, the abutment 28 reduces the tensile force on the adhesive strip (i.e. the force in the direction normal to the wall surface 12) that would otherwise be placed on the top of the adhesive strips 14 as the back plates 8,10 pivot toward the wall surface 12 along the bottom of the shelf 2 and away from the wall surface 12 along the top of the shelf 2. In this manner, the peel force at the top of the adhesive strips 14 is reduced and the overall holding capacity of the shelf 2 is further increased.

In the illustrated embodiment, the frame 4 is a continuous rigid rod. To allow the shelf 2 to be transported or stored more compactly, the frame 4 may include a hinged construction that would allow the side rails 4*c* to be folded such that the top rail portion 4*a* and front rail portion 4*b* of the frame are arranged adjacent to each other.

To allow water to drain through the base member 6, the base member 6 optionally contains openings 18. Because the base 6 is arranged at an angle and water will tend to collect along the bottom of the base member 6 (i.e. where the support surface 6*a* meets the back surface 6*b*), the base member 6 may also include holes or slots where the bottom surface 6*a* meets the back surface 6*b* to facilitate water drainage along the bottom of the base member 6.

The shelf 2 may also include optional side walls 22 (FIG. 1) arranged between each side rail back portion 4*c*' and each side rail bottom portion 4*c*", or may include rails extending from the side rail back portion and the side rail bottom portion.

A support bar 24 (FIG. 2) extends between the side rail portions 4*c* adjacent the back plates 8,10, and the base member 6 includes a lip 26 arranged for mating engagement with the support bar 24. The support bar 24 and lip 26 allow the base member 6 to be quickly and easily connected with, and removed from, the back plates 8,10. In addition, because the back of the frame is open (i.e. because the base member 6 does not extend up to the top rail portion 4*a* of the frame 4 when the base member 6 is connected with the frame 4), and because the back plates 8,10 serve to space the frame 4 from the wall surface 12, a user can easily connect and disconnect the base member 6 from the frame 4.

The stretch releasing adhesive strips 14 include an adhesive portion 14*a*, which is concealed by the back plates 8,10 in FIGS. 1 and 2, and a non-adhesive pull tab portion 14*b* that extends outwardly beyond the bottom the back plates 8,10 as shown most clearly in FIG. 2. Arranged in this manner, when the base member 6 is connected to the frame 4, the base member 6 serves to conceal the non-adhesive pull tab portions 14*b*, but when the base member 6 is removed from the frame 2, the non-adhesive pull tabs 14*b* are visible and can be readily accessed by a user wishing to stretch remove the adhesive strips 14 from the wall surface 12.

In the case where the adhesive strips 14 include a separable fastener, such as is described in U.S. Pat. No. 6,972,141 (Bries et al.), the adhesive strips 14 may be arranged such that both the adhesive portion 14*a* and the non-adhesive pull tab portion 14*b* of the adhesive strip are concealed by the back plates 8,10. This is possible because the adhesive strips can be removed by first separating each adhesive strip via the separable fastener and then stretch removing each remaining half of each adhesive strip from its respective surface.

The shelf 2, including the frame 4, the base 6, and the back plates 8,10 may be formed of any suitable material such as, for example, metals and synthetic plastic materials. A particularly suitable material for the frame 4 is vinyl coated wire.

Persons of ordinary skill in the art may appreciate that various changes and modifications may be made to the invention described above without deviating from the inventive concept. Thus, the scope of the present invention should not be limited to the structures described in this application, but only by the structures described by the language of the claims and the equivalents of those structures.

What is claimed is:

1. A wall mountable shelf, comprising:

(a) a frame comprising a top rail portion, a front rail portion, and a pair of side rail portions connecting the top rail portion and the front rail portion, wherein each side rail portion includes a back portion extending downwardly from the top rail portion and a bottom portion extending from the back portion to the front rail portion, and further wherein each side rail back portion and each side rail bottom portion are arranged at an angle of less than 90°;

(b) a base removably connected with the frame, the base extending an entire lateral distance between the side rail bottom portions;

(c) at least one back plate connected with the frame and arranged to support the frame on the wall; and (d) at least one stretch removable adhesive strip arranged between the back plate and the wall for securing the shelf to the wall surface;

and wherein:

the at least one stretch removable adhesive strip includes an adhesive portion and a non-adhesive pull tab portion that extends outwardly beyond the bottom of the back plate;

the frame includes a support bar extending between the side rail portions;

the at least one back plate extends from the top rail portion to the support bar; and, the base includes:

a lip arranged along a top edge of the base for engagement with the support bar, and, a back wall portion extending upwardly at least partially along the side rail back portions, thereby to conceal the non-adhesive pull tab portion of the adhesive strip when the base is connected with the frame.

2. A shelf as defined in claim 1, wherein the frame is constructed from a rod.

3. A shelf as defined in claim 1, wherein the base includes drainage openings.

4. A shelf as defined in claim 1, further comprising side walls arranged between each side rail back portion and each side rail bottom portion.

5. A shelf as defined in claim 1, comprising a pair of back plates arranged at opposite ends of the top rail portion adjacent each side rail portion.

6. A shelf as defined in claim 1, further comprising an abutment arranged along the bottom of the shelf adjacent the wall surface, whereby the abutment is urged into engagement with the wall surface as items are placed on the shelf.

7. A shelf as defined in claim 6, wherein the abutment is formed apart from the back plate and is arranged to reduce a tensile force on the adhesive strip when secured to the wall surface as items are placed on the shelf.

8. A shelf as defined in claim 1, wherein the adhesive portion is concealed by the at least one back plate.

9. A shelf as defined in claim 3, wherein the drainage openings are positioned where the bottom surface meets the back surface.

10. A shelf as defined in claim 1, wherein the shelf is configured for mounting to a wall in a shower and the stretch removable adhesive strip is configured to maintain a holding power in the presence of water.

11. A shelf as defined in claim 1, wherein the base, when connected with the frame, is not adjustably positionable toward or away from either of the side rail portions along a direction generally aligned with a long axis of the front rail portion.

* * * * *